US005298281A

United States Patent [19]

Lowther

[11] Patent Number: 5,298,281

[45] Date of Patent: Mar. 29, 1994

[54] METHOD OF TREATING TUBULARS WITH A PLURALITY OF ABLATING GELATIN PIGS

[75] Inventor: Frank E. Lowther, Plano, Tex.

[73] Assignee: Atlantic Richfield Company, Los Angeles, Calif.

[21] Appl. No.: 876,989

[22] Filed: May 1, 1992

[51] Int. Cl.[5] ..... B05D 5/12

[52] U.S. Cl. ..... 427/128; 427/130; 427/139

[58] Field of Search ..... 427/230, 239, 128

[56] References Cited

U.S. PATENT DOCUMENTS 3,863,717 2/1975 Cooper ..... 166/279

*Primary Examiner*—Bernard Pianalto

*Attorney, Agent, or Firm*—Drude Faulconer

[57] ABSTRACT

A method for treating tubulars wherein a plurality of ablating, gelatin pigs are sequentially passed through the tubular to deposit a relatively thin film or protective layer of gelatin onto the wall of the tubular. All of the plurality of pigs are inserted into the tubular at a single insertion point but each pig substantially treats only its respective portion or length of the tubular. That is, a first pig deposits a gelatin layer on the wall of a first portion or length of the tubular, a second pig deposits a layer on a second portion or length of the tubular, and so forth.

16 Claims, 2 Drawing Sheets

METHOD OF TREATING TUBULARS WITH A PLURALITY OF ABLATING GELATIN PIGS

1. TECHNICAL FIELD

The present invention relates to a method for treating tubulars and in one of its aspects relates to a method of treating a length of a tubular wherein a layer of gelatin is deposited onto the interior wall of the tubular by passing a first ablating gelatin pig through a first portion of the length and subsequently passing at least one additional ablating gelatin pig through the entire length to be treated.

2. BACKGROUND ART

Most tubulars which carry fluids must be treated periodically to extend their operational life and/or to improve and maintain their operating efficiencies. For example, tubulars such as well tubing and casing strings, pipelines, flowlines in refineries, and the like which are used for transporting crude oil and/or natural gas which, in turn, contain even small amounts of water routinely experience severe corrosion problems which, if not timely treated, can result in early failure of the tubular. Also, the interior surfaces of the tubulars have a substantial "roughness" even when new which increases with scaling, pitting, etc. during use. As this roughness increases, the friction or "drag" between the tubular wall and the fluids flowing therethrough increases thereby substantially reducing the flowrate through the tubular.

In most known corrosion and/or drag reduction treatments of tubulars, a layer or film of an appropriate treating solution, i.e. corrosion inhibitor or drag reducer, is deposited onto the interior surface or wall of the tubular. In corrosion treatment, the film of corrosion inhibitor protects the wall from contact with water or other electrolytes or oxidizing agents while in drag reduction, the film of drag reducer fills pits, etc. to "smooth" out the wall surface to reduce the friction between the flowing fluids and the tubular wall. In still other instances, tubulars may be treated for other problems, e.g. bacteria buildup, etc. wherein different treating solutions are used, e.g. biocides, herbicides, etc..

There have been several techniques proposed for providing a film of treating solution onto the wall of a tubular. Probably the most commonly-used technique for treating pipelines involves merely adding the treating solution to the fluids flowing through the pipeline and/or periodically flowing a separate slug of the liquid treating solution through the line. Due to the properties of treating solution, it migrates outward against the pipe wall and adheres thereto; hopefully forming a relatively uniform layer or thin film on the entire surface of the wall. Of course, insuring that such a uniform layer of solution will actually be deposited and remain on the wall is extremely difficult, if possible at all. Further, the amount of treating solution that must be used is several magnitudes greater than is required to form the desired the layer on the pipe wall. Accordingly, large volumes of solution are wasted with no benefits being derived therefrom thereby making this technique very expensive.

Other known techniques for treating tubulars involve flowing slugs of treating solution between mechanical plugs or "pigs" or dispensing the solution directly onto the wall from specially-designed pigs. In addition to other factors, special pig "launchers" and "catchers" have to be installed into the pipeline to handle the mechanical pigs which adds substantially to the cost and operating problems. Also, mechanical pigs routinely experience trouble in negotiating the bends, etc. normally present in most pipelines.

Another method for treating tubulars involves the use of a compliant pig or pigs formed from "gelled" materials. One such gelled material is formed by gelling a liquid hydrocarbon with a gelling agent (e.g. alkyl orthophosphate ester) and an activator (e.g. sodium aluminate). A pig made of this material, which may also contain a corrosion inhibitor, is forced through the pipeline by either a liquid or a gas to deposit a protective layer on the pipe wall; see Canadian Patent 957,910

Recently, another but substantially different material has been used to form compliant pigs which have been successfully used in the treatment of large-diameter tubulars. This material is common or technical "gelatin"; see co-pending U.S. patent application ser. Nos.(1) 07/683,164, filed Apr. 10, 1991; (2) 07/697,543, filed May 9, 1991; (3) 07/853,874, originally filed May 24, 1991, and (4) 07/732,013, filed Jul. 18, 1991, all commonly assigned with the present invention. The basic pig used in each of these tubular treating methods is formed primarily of a mass of common gelatin of the type used in foods, glues, etc.. The gelatin mass is passed through a tubular where it ablates against the tubular wall to deposit a treatment layer of gelatin onto the wall of the tubular.

Pigs formed of common gelatin appear to have several advantages over the previously known gelled-hydrocarbon or the like pigs. First, a gelatin pig is primarily formed from everyday, common gelatin which is readily-available and relatively inexpensive. Further, being made of gelatin, the pig is extremely safe to handle and offers no danger to the operating personnel or the environment. Still further, a gelatin pig can be formed in an external mold and then inserted into the tubular or, as preferred, it can be formed, in situ, within the tubular, itself. Also, the consistency or structural integrity of a gelatin pig, when gelled, is much greater that of that of known gelled-hydrocarbon masses ao that it does not require a mechanical pig to push it through a tubular as does most pigs formed from gelled-hydrocarbons. This eliminates the need for expensive mechanical pig "launchers and catchers" in the tubular.

While gelatin pigs have found good acceptance for treating tubulars, especially those having large diameters (e.g. up to 48 inch diameter pipelines) there may be instances where the size and length of the tubular to be treated makes it difficult to treat the entire length of the tubular with a single gelatin pig. For example, the length of a single gelatin pig required to provide a protective layer having a thickness of approximately 3000 microinches over 100 miles of a 12-inch diameter pipeline would need to be approximately 500 feet long. In addition to the difficulty in negotiating a pig of this length through the bends and/or constrictions normally found in a pipeline, the pig would have such a mass (e.g. weight) whereby it would be difficult, if possible at all, for acceptable flowrates and pressures in a normal pipeline to move the pig therethrough.

One way to reduce the size of any one gelatin pig is to provide multiple insertion points spaced along the tubular through which several smaller gelatin pigs can be introduced. Each gelatin pig travels through and treats only a relative short length of tubular between adjacent insertion points. While the insertion of gelatin pigs do not require an expensive pig launcher or catcher such as required with mechanical pigs. some modification of the tubular must still be made at each of the insertion points which adds to the overall expense and personnel required for treating the tubular.

SUMMARY OF THE INVENTION

The present invention provides a method for treating a long length of tubular, e.g. pipeline, wherein a plurality of ablating, gelatin pigs are sequentially launched from a single insertion point and each is passed through the tubular to ablate and deposit a relatively thin film or protective layer of gelatin onto the wall of a respective length or portion of the tubular. Each pig is sized so that its mass can be easily moved through the tubular by the fluids flowing therethrough.

More specifically, a first gelatin pig is positioned into the tubular at an insertion point which is located at one end of the length of tubular to be treated. The first gelatin pig is formed of mass of gelatin which is sufficient to contact the interior wall of said tubular only until it passes through said first portion of said tubular. Flow in the tubular moves the first gelatin pig through the first portion of the tubular and friction caused by the pig moving therethrough causes the pig to ablate and deposit a gelatin layer onto the wall of the first portion of the tubular. A second gelatin pig is then positioned within the tubular at the same insertion point and is moved by flow of fluids in the tubular through both the first portion and a contiguous second portion of the tubular.

The layer of gelatin deposited by the first pig provides a good insulation for the second pig as it moves through the first portion of the tubular so that friction is reduced to a point where little, if any, ablation of the second pig will occurs as it moves through the first portion of the tubular. The second gelatin pig is formed of a mass of gelatin sufficient to pass through both the first and second portions of said tubular, but since there is little, if any, ablation of the second pig as it passes through the first portion, the mass of the second pig will be substantially or only slightly greater than that of the first gelatin pig. When the second pig reaches the end of the first portion and contacts the untreated or bare wall of the contiguous second portion, the friction increases and the second pig will ablate to deposit a layer of gelatin onto the wall of the second portion or length of the tubular. Additional ablating, gelatin pigs can be launched from the same insertion point to treat additional portions or lengths of the tubular if desired, again with little or no ablation occurring as the pig moves through previously treated portions.

Each ablating gelatin pig may be formed as an integral mass or in some instances may be formed of components or modules of gelled gelatin which are then accumulated into a mass which functions in the same way as if the mass was integral. Also, in some treatments, a "hardener" may be used to react with the gelatin to protect the gelatin against softening or melting at the operating temperatures.

BRIEF DESCRIPTION OF THE DRAWINGS

The actual construction, operation, and apparent advantages of the present invention will be better understood by referring to the drawings in which like numerals refer to like parts and in which.

BEST KNOWN MODE FOR CARRYING OUT INVENTION

Figures 1, 2, 3:
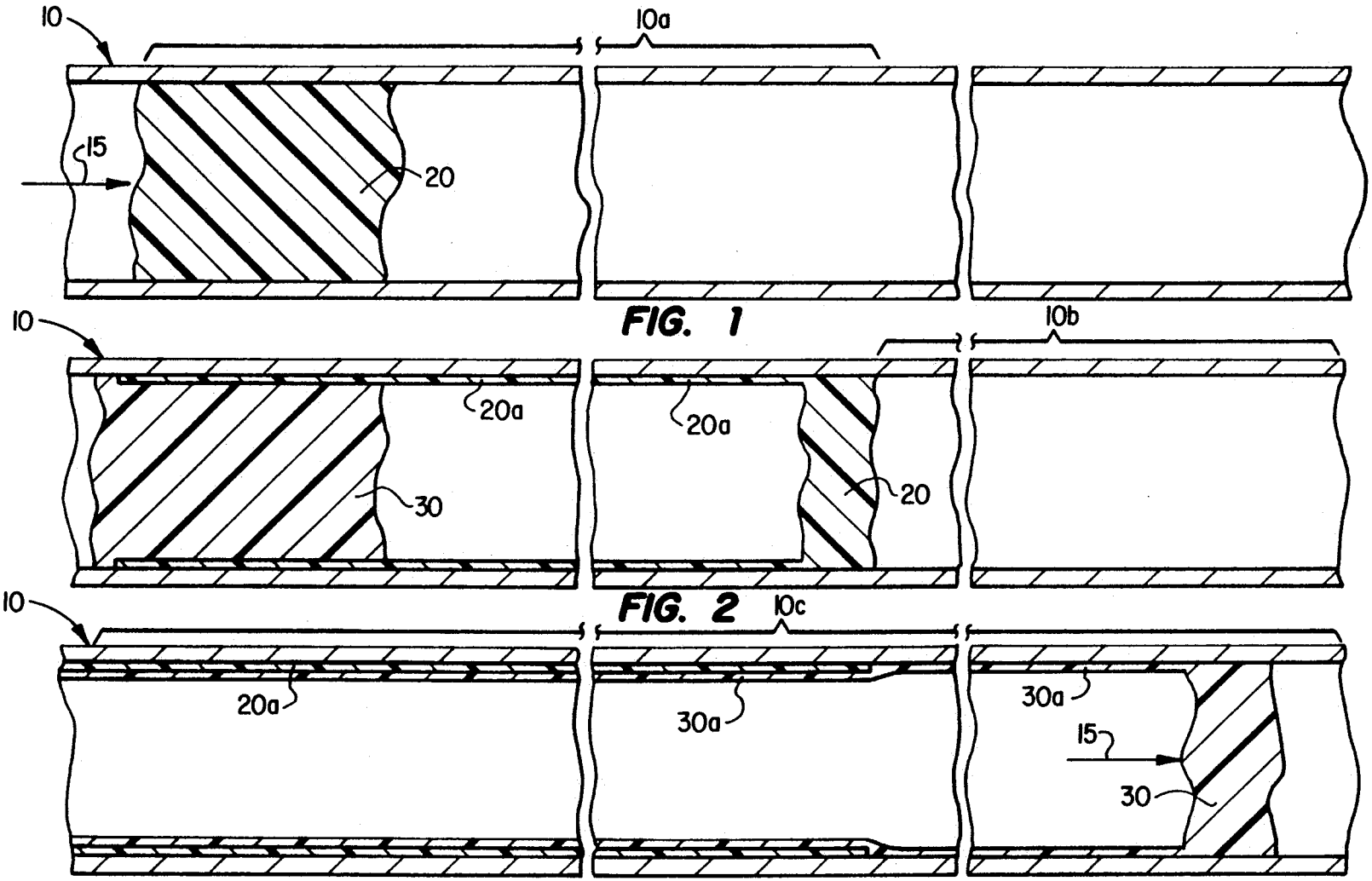
FIG. 1 is a sectional view, partly broken away, of a length of a tubular to be treated in accordance with the present invention and having a first gelatin pig positioned therein at one end thereof.
FIG. 2 is the sectional view of FIG. 1 wherein said first gelatin pig has substantially passed through a first portion of said tubular and having a second gelatin pig positioned at said one end.
FIG. 3 is the sectional view of FIG. 2 wherein said second gelatin pig has substantially passed through the entire length of the tubular.

In accordance with the present invention, a method is provided for treating tubulars wherein a plurality of ablating, gelatin pigs are sequentially passed through the tubular to deposit a relatively thin film or protective layer of gelatin onto the wall of the tubular. All of the plurality of pigs are inserted into the tubular at a single insertion point but each pig substantially treats only its respective portion or length of the tubular That is, a first pig deposits a gelatin layer on the wall of a first portion or length of the tubular, a second pig deposits a layer on a second portion or length of the tubular, and so forth.

As used herein, "tubular" is intended to include any pipe or conduit through which fluids (i.e. liquids and gases) and solids (i.e. particulates) are flowed. While the present invention will be described primarily in relation to a substantially horizontal pipeline which carries crude oil, natural gas, and/or other products, it should be understood that it equally applies in treating substantially vertical and/or horizontal tubulars such as well casings and tubings, flowlines in refineries, waterpipes or other conduits, etc..

Each of the plurality of ablating, gelatin pigs used in the present invention are bascially the same in that each is substantially comprised of a mass of common (sometime called "technical") "gelatin". Gelatin, when mixed in solution and gelled, is a material which is capable of recovering from large deformations quickly and forcibly which, in turn, allows a pig formed therefrom to easily negotiate bends, constrictions, and the like in a tubular, e.g. pipeline. The ambient heat of the fluids flowing in the pipeline and/or the heat generated by the friction of the moving pig against the wall of the pipe causes the gelatin pig to "ablate" to deposit a fairly-uniform layer of gelatin onto the wall.

As is well known and as used herein, "gelatins" is a definite term of art which specifically identifies high molecular weight polypeptides derived from collagen which, in turn, is the primary protein component of animal connective tissue (e.g. bones, skin, hides, tendons, etc.). Gelatin, which is commonly used in foods (highly refined), glues (lesser refined), photographic and other products, does not exist in nature and is a hydrolysis product obtained by hot water extraction from the collageous raw material after it has been processed with acid, alkaline, or lime. The viscosity of aqueous gelatin solutions increases with increasing concentrations and decreasing temperatures. For a more complete description and discussion of gelatin, its compositions and properties, see ENCYCLOPEDIA OF CHEMICAL TECHNOLOGY, Kirk-Othmer, 3rd Edition, Vol. 11, J. Wiley & Sons, N.Y., pps. 711 et sec.

While gelatin, itself, effectively adheres to the tubular walls in most applications, this adhesion may be reinforced by the magnetic particles which may be thoroughly mixed and entrained in the mass of gelatin and which are deposited along with the gelatin onto the wall of the tubular. The latent magnetism of these particles provide a magnetic force which attract each other and to the wall of a magnetic tubular, e.g. steel. The magnetic particles are comprised of magnetized, microsized particles of a supermagnetic material (e.g. iron oxide) of the type commonly used in printer inks, toners, etc., (e.g. magnetic particles commercially-available from Wright Industries, Inc., Brooklyn, N.Y. such as Type 4000 (0.05 micron diameter particles); Type 012672 (0.3 microns); Type 041183 (12 microns) etc.. For a more complete description of such a pig, see co-pending U.S. patent application Ser. No. 07/853,874 and incorporated herein by reference.

Further, the gelatin, itself, acts a treating agent (e.g. as a corrosion inhibitor and/or a drag reducer) when deposited onto the tubular wall Preferably, however, a separate treating solution is incorporated into the gelatin mixture either with or without the magnetic particles, see co-pending U.S. patent application Ser. No. 07/683,164. The treating solution becomes entrained within the gelatin molecules as a gelatin mixture is cooled below its gelling temperature. In corrosion treatments, the treating solution can be almost any known corrosion inhibitor of the type used to treat tubulars. Examples of good corrosion inhibitors are (1) an aqueous blend of fatty acid imidazoline quaternary compound and alcohol, e.g. commercially-available as NALCO 3554 INHIBITOR; (2) an alkylamide polyamide fatty acid sulfonic acid salt in a hydrocarbon solvent, e.g. VISCO 945 CORROSION INHIBITOR; (3) an imidazoline fatty acid, e.g. OFC C-2364 CORROSION INHIBITOR.

In drag reduction treatments, any known drag reducer of the type used to reduce drag in tubulars can be incorporated into the compliant pig. For example, many of the above-identified corrosion inhibitors are also good drag reducers thereby producing the combined benefits of reducing drag and inhibiting corrosion. Also, high molecular weight (e.g. $10^6$) homopolymers, e.g. polyethylene oxide, are good drag reducers in that the high weight molecules at least partially "fill" any indentations in the pipewall to "smooth" out the roughness of the wall thereby reducing drag between the pipewall and the flowing fluids. Further, other treating solutions such as biocides, herbicides, etc. can be incorporated into the ablating gelatin pig if desired for a particular treatment.

When formulating gelatin mixtures, it has been found that the hardness (i.e. firmness) of the cooled (i.e. gelled) gelatin is primarily dependent on the amount of gelatin in the mixture and is relatively independent on the composition of the liquid solution used to form the mixture. For example, a gelatin mass formed with approximately 17% gelatin and a liquid comprised of 30% water and 70% treating solution (e.g. NALCO 3554 INHIBITOR) has substantially the same hardness as that of a mass formed with the same amount of gelatin and a liquid comprised of 70% water and 30% treating solution (NALCO 3554).

The exact formulation of a particular gelatin mixture used to form the pigs used in the present invention will vary with the actual components used, the environment in which a gelatin pig is to be used, the treatment to be carried out, etc.. For example, the amount of gelatin which can be combined with liquid (e.g. water) to form a suitable pig for differring applications can range anywhere from about 2% to about 85%, depending on the actual circumstances involved. The following specific example illustrates a typical gelatin mixture which can be used to used in the present treatment method:

100 parts of a treating solution (e.g. NALCO 3554) is mixed thoroughly with 100 parts by weight of hot water (180° F.) and 60 parts by weight of technical gelatin is blended into the hot liquid mixture. The temperature of the gelatin-liquid mixture at this point should be at least 170° F. The gelatin-liquid mixture is allowed to cool to ambient temperature (e.g. room temperature) to thereby form the mass of gelatin which becomes the pig, as will be described in detail below. When magnetic particles are incorporated into the mass, a typical mixture can be comprised of thirty-six percent (36%) by weight of a treating solution (e.g. NALCO 3554) mixed thoroughly with an equal amount of hot water (180° F.). Fourteen point four percent (14.4%) by weight of gelatin is blended into the hot liquid mixture along with thirteen and one-half percent (13.5%) of magnetic particles (e.g. magnetized iron oxide). The warm gelatin mixture may be poured into an external mold where it is allowed to cool to form an integral mass of gelatin basically in the shape of the mold. Preferably, however, it is mixed and allowed to cool inside the tubular, itself, to form the respective pig, in situ.

Referring now to the drawings for a more complete understanding of the invention, FIG. 1 illustrates a length (e.g. 10–100 miles) of a typical large tubular or pipe 10 (e.g. 6-inch to 48-inch diameter) of the type used in constructing pipelines which carry hydrocarbons and the like. A first ablating, gelatin pig 20 is positioned into pipe 10 through an insertion point (not shown) at one end of the length **10*c* of pipe to be treated. As discussed above, the pig can be formed externally and then inserted into pipe 10** or it can be formed in situ. The latter may be accomplished by ceasing the flow of fluids through the pipe, flowing a hot gelatin mixture into the pipe through a simple valved-inlet (not shown), and then allowing the mixture to cool before resuming flow in the pipe. The pressure of the flowing fluids will push the pig through the pipe.

Upon resumption of flow, the pressure of the fluids being pushed ahead of pig 20 act on the leading face of the pig while the pressure of the flowing fluids (represented by arrow 15) act on its rear face. These opposed pressures will cause the pig to compress radially with respect to its longitudinal axis which, in turn, continuously forces the periphery of pig 20 into contact with the pipewall, even as gelatin from the pig ablates against the wall. This is true regardless whether the diameter of the pig is originally smaller, larger, or approximately the same as the diameter of the pipe 10. The temperature of the pipewall 10 and/or the heat generated by the friction of pig 20 as it moves along in contact with the interior wall of the pipeline causes the gelatin pig to ablate to thereby deposit a layer **10*a*** of gelatin (and any treating solution and/or magnetic particles, if present) onto the pipewall. The temperature at which a typical gelatin pig ablates is around 100° F.

Figure 4:
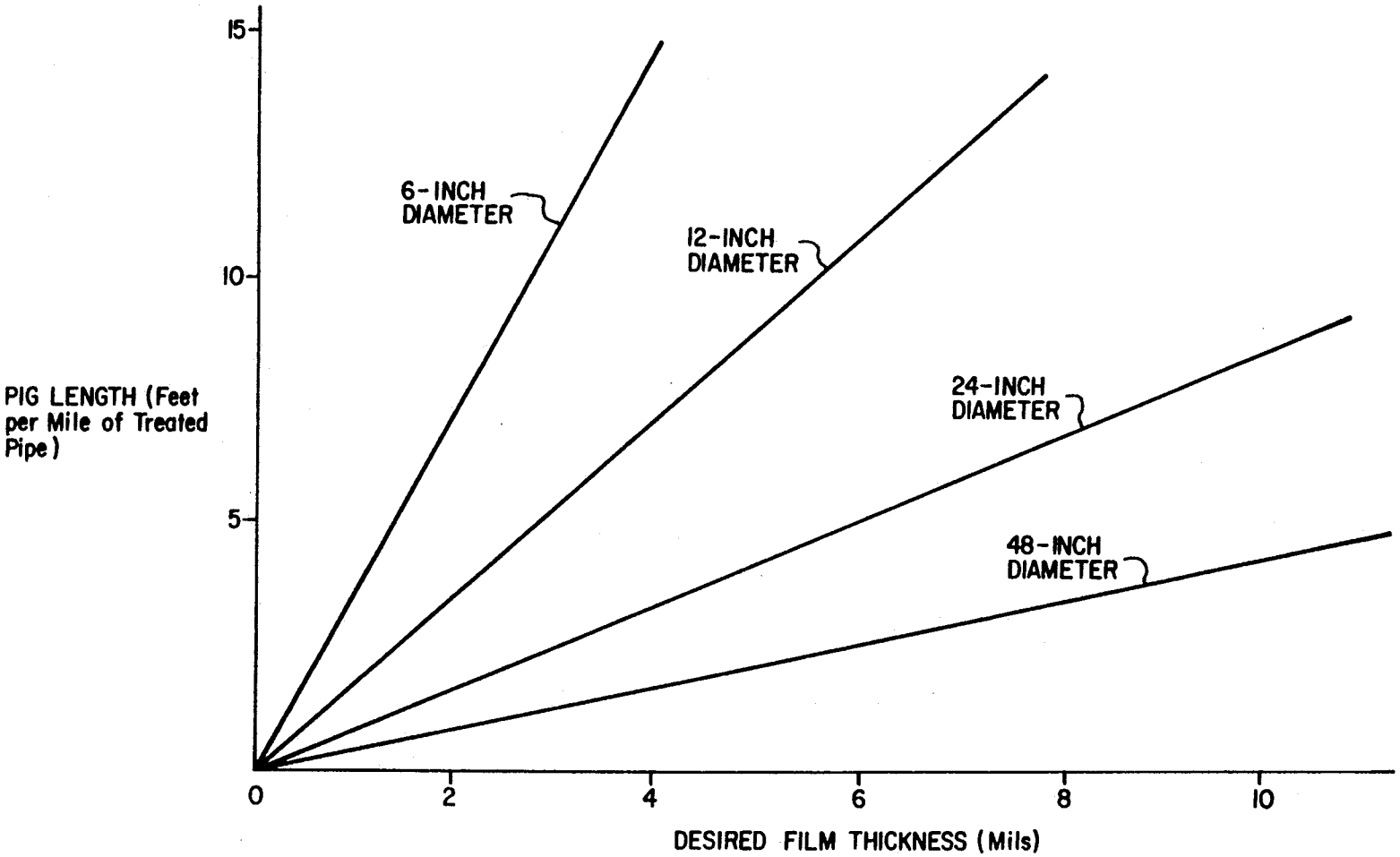
FIG. 4 is a representative graph plotting the different lengths of a gelatin pig required to deposit respective thicknesses of a treatment layer per mile in different-diameter tubulars.

If practical, only a single pig would be required to treat the entire length **10*c* of pipe 10**. However, the length of many pipes, e.g. pipelines, which must be treated are so long that the use of a single treatment pig is impractical. For example, as seen from the graph in FIG. 4, the length of a typical ablating, gelatin pig required to deposit a thickness layer of gelatin of 1 mil (i.e. one thousandth of an inch) onto the wall of a 6-inch diameter pipe would be approximately 5 feet for every mile of pipe to be treated. Accordingly, if the pipe were 10 miles long, a single gelatin pig would have to have a length of approximately 50 feet. The mass of such pigs is considerable which, in turn, makes it difficult, if possible at all, for the pig to be propelled or pushed through the pipe by the normal flowrates and pressures in the pipe.

Again referring to the present invention, first pig 20 is sized so that its mass can easily be pushed through the pipe by the normal flowrates and pressures of the fluids which flow therethrough. By reducing the mass of the pig, its length is also reduced to one which can easily negotiate any bends and/or constrictions normally present in the length of pipe to be treated. In order to reduce the mass of any one pig, first gelatin pig 20 is sized so that it can only deposit a layer 20*a* of gelatin a first portion 10*a* before it will be effectively consumed by ablation. Note that although the length of pipe 10 is actually contiguous, for purposes of clarity in describing the invention, pipe 10 is referred to as having contiguous "portions" which represent respective lengths of pipe which are to be treated by respective pigs.

After first ablating, gelatin pig 20 has been substantially consumed by ablation, a second ablating, gelatin pig 30 is positioned within pipe 10 at the same insertion point at which pig 20 was positioned. By starting all of the pigs at the same location, only one entry or insertion point needs be provided in pipe 10 which is an important consideration in most commercial pipeline operations. For purposes of description, pig 30 is the same as pig 20. However, it should be recognized that the actual compositions can vary if a situation dictates; (e.g. one pig can have more or less treating fluid, magnetic particles, gelatin content, etc. than the others pigs). Flow in pipe 10 is resumed which will cause pig 30 to pass through first portion 10*a* of pipe 10 and on into and through second portion 10*b*. The layer 20*a* of gelatin which has been deposited from pig 20 provides, in itself, a good lubricating film throughout first portion 10*a* which, in turn, substantially reduces the friction between pig 30 and the wall of portion 10*a* to a level where there will be little, if any, ablation of pig 30 as it passes through first portion 10*a*. Accordingly, if any additional gelatin is ablated in portion 10*a*, it will be only an extremely small amount (illustrated as 30*a* in the figures).

As second pig 30 reaches the end of treated first portion 10*a*, hence the end of layer 20*a*, it passes into second portion 10*b* of pipe 10 and contacts the untreated or bare pipewall. The friction between the bare wall and pig 30 increases substantially which now causes pig 30 to ablate in the same manner as first pig 20 ablated within first portion 10*a*. This ablation of pig 30 deposits a layer of gelatin 30*a* onto the pipewall. Note: the thicknesses of both layer 20*a* and 30*a* have been highly exaggerated in the figures for the sake of clarity and are not intended to represent the actual or relative thicknesses of either layer. The mass of each particular pig required to treat its respective length or "portion" of tubular can be determined from basic geometrical calculations based on the diameter and length of the portion tubular to be treated, the rate of ablation, the thickness of layers 10*a*, 10*b*, etc..

While the tubular illustrated in the figures has its length "divided" into only two portions, it should be understood that the length of a particular tubular can be "divided" into as many portions is practical to keep the mass of each individual gelatin pig small enough to allow the normal operating parameters (e.g. allowable flowrates and pressures) to move the respective pigs through the length of tubular being treated. Regardless of the actual number of pigs used, each will be sequentially launched from the same insertion point at one end of the tubular and each will only substantially ablate as it passes through its respective portion of the tubular.

Each ablating gelatin pig may be formed as an integral mass, as discussed above, or it may be formed of components or modules of gelled gelatin which are then accumulated into a mass which functions in the same way as if the mass was integral, see copending U.S. patent application Ser. No. 07/732,013, filed Jul. 18, 1991, and incorporated herein by reference.

Further, in some treatments, the ambient temperature in the tubular may be high enough (e.g. substantially above 100 ° F.) to adversely affect the gelatin layer after it has been deposited onto the wall of the tubular. Accordingly, a "hardener" may be used to react with the gelatin to protect the gelatin against softening or melting at the operating temperatures. The hardener also toughens the gelatin in the layer and makes it resistant to abrasion. Examples of such hardeners (e.g. formaldehydes) are those used to harden gelatin in photography applications, see THE THEORY OF THE PHOTOGRAPHIC PROCESS, Third Edition, The Macmillan Co., N.Y. Chapter 3, pps. 45–60. The hardener may be added to the gelatin-hot liquid mixture during the formation of the pig to contol the melting or ablating point of the pig.

What is claimed is:

1. A method for treating a length of tubular having at least first and second contiguous portions, said method comprising:

passing a first ablating gelatin pig through said tubular, said first gelatin pig having a first mass of gelatin sufficient to contact the interior wall of said tubular only until it passes through said first portion of said tubular to ablate and deposit a layer of gelatin onto said wall of said first portion; and passing a second ablating gelatin pig through said first and said second portions of said tubular, said second gelatin pig having a second mass of gelatin sufficient to pass through said first portion of said tubular and through said second portion to contact the interior wall of said second portion and ablate to deposit a layer of gelatin onto said wall of said second portion of said tubular.

2. The method of claim 1 wherein said first and second masses of gelatin are formed from a mixture of (a) technical gelatin of the type derived from collagen and (b) a liquid.

3. The method of claim 2 wherein said mixture includes a treating solution.

4. The method of claim 3 wherein said treating solution comprises:

a corrosion inhibitor.

5. The method of claim 3 wherein said treating solution comprises:

a drag reducer.

6. The method of claim 2 said gelatin mixture is mixed in said tubular and allowed to cool therein to form said both first and said second pigs, respectively, in situ in said tubular.

7. The method of claim 2 including:

adding a hardener to said gelatin mixture for increasing the temperature at which the mass of gelatin will ablate.

8. The method of claim 2 wherein said mixture has magnetic particles entrained therein.

9. The method of claim 2 wherein said first and second masses of gelatin are formed, respectively, of individual components of gelled technical gelatin, said components being accumulated into a non-consolidated mass to form said respective first and second pigs.

10. A method for treating a length of tubular having at least first and second contiguous portions, said method comprising:

positioning a first ablating gelatin pig into the tubular at a launch point at one end of said first portion, flowing fluids through said tubular to cause said first gelatin pig to move through said first portion, said first gelatin pig being formed of a first mass of gelatin sufficient to contact the interior wall of said tubular only until said first pig passes through said first portion of said tubular whereby said first pig will ablate and deposit a layer of gelatin onto said wall of said first portion;

positioning a second ablating gelatin pig into said tubular at said launch point at one end of said first portion; and flowing fluids through said tubular to cause said second gelatin pig to move through said both said first and second portions of said tubular, said second ablating gelatin pig, formed of a second mass of gelatin sufficient to pass through said first portion of said tubular and through said second portion and contact the interior wall of said second portion to ablate and deposit a layer of gelatin onto said wall of said second portion of said tubular.

11. The method of claim 10 wherein said first and second masses of gelatin are formed from a mixture of (a) technical gelatin of the type derived from collagen and (b) a liquid.

12. The method of claim 11 wherein said mixture includes a treating solution.

13. The method of claim 12 wherein said treating solution comprises:

a corrosion inhibitor.

14. The method of claim 12 wherein said treating solution comprises:

a drag reducer.

15. The method of claim 11 wherein said gelatin mixture is mixed in said tubular and allowed to cool therein to form said both first and said second pigs, respectively, in situ in said tubular 16. The method of claim 11 including:

adding a hardener to said gelatin mixture for increasing the temperature at which the mass of gelatin will ablate.

* * * * *